US006036592A

United States Patent [19]

Rubin

[11] Patent Number: 6,036,592

[45] Date of Patent: Mar. 14, 2000

[54] ASHTRAY ASSEMBLY FOR USE WITH SMOKE REMOVAL APPARATUS

[76] Inventor: Benjamin Rubin, 104-60 Queens Blvd., Forest Hills, N.Y. 11375

[21] Appl. No.: 09/093,668

[22] Filed: Jun. 8, 1998

Related U.S. Application Data

[62] Division of application No. 08/898,298, Jul. 22, 1997.

[51] Int. Cl.[7] ..... B08B 15/02

[52] U.S. Cl. ..... 454/63; 131/240.1

[58] Field of Search ..... 454/63, 65, 56, 454/341, 230; 211/70.3; 131/240.1, 257, 242

[56] References Cited

U.S. PATENT DOCUMENTS 5,722,438 3/1998 Gors ..... 131/231

*Primary Examiner*—Harold Joyce
*Assistant Examiner*—Derek S. Boles
*Attorney, Agent, or Firm*—Bauer & Schaffer, LLP

[57] ABSTRACT

An ashtray for use with an apparatus for the reduction of tobacco smoke, the ashtray having a body with a peripheral wall and separating wall for defining a first area for extinguishing a cigarette and a second area for disposing ash therein. The ashtray is provided with a cover having a bottom wall, a back wall and a hingedly mounted cover flap.

4 Claims, 5 Drawing Sheets

ASHTRAY ASSEMBLY FOR USE WITH SMOKE REMOVAL APPARATUS

RELATED APPLICATION

The present application is a divisional of copending application Ser. No. 08/898,298 filed on Jul. 22, 1997 entitled Apparatus for the Removal of Second Hand Smoke for which benefit under 37 USC 120 is claimed.

BACKGROUND OF THE INVENTION

The present invention relates to an apparatus for the reduction of tobacco smoke produced in a closed environment, and in particular, to apparatus for the removal of "second hand smoke", i.e., smoke exhaled into the environment and smoke originating when a cigarette is held in the hand.

The conventional manner of dealing with the problem of second hand smoke has been to enjoin the use of tobacco in its entirety. However, since smoking in casinos is an inherent part of the gambling milieu, prohibiting smoking in its entirety can result in loss of patronage and damage to the establishment. Another attempted solution has been to provide increasingly stronger apparatus' for ventilizing such rooms. Such equipment is not only larger, but is more costly and complex both in installation and in use.

It has been found that the conventional apparatus, normally placed within the ceiling of the casino, is only partially effective in removing all the smoke. Such equipment removes air, and, therefore, whatever smoke found in it is from the upper level of the room. It is significantly less effective in capturing and removing the smoke and especially the particulates in the smoke from the lower half of the room, particularly smoke produced and found on the level of the patrons producing such smoke. It is the smoke in this space which is most detrimental to smokers and non-smokers as "second hand smoke".

Casino floor employees, in particular, have no way of avoiding the damaging exposure to their health during their lifetime of service. They are very much aware, today, of the price they may have to pay for the privilege of holding on to a job.

It is an object of the present invention to provide an apparatus which acts to capture the smoke as it is generated by the smoker in the lower level in a casino; the areas occupied by the slot and video machines. This apparatus then transmits the smoke to the upper levels of the room to be handled by the ventilating equipment.

It is another object of the present invention to provide casinos and similarly large establishments with equipment to remove smoke immediately upon its creation.

These objects together with other objects and advantages are set forth in the following disclosure.

SUMMARY OF THE INVENTION

According to the present invention, the apparatus comprises a smoke removal chimney assembly for receiving smoke. The chimney assembly is mounted on a base located adjacent the seat or table at which the patron sits, and is adjustable to be positioned directly to the side of the patron at the level of the patrons face. The chimney assembly comprises a duct-like cylinder provided with an opening into which the patron expels the smoke. The cylinder is elongated, rising to the height of approximately five feet above the floor. At the upper end of the duct, there is provided a fan which sucks the smoke up and then propels it to an upper level beyond a 5 ft. rise, toward the ventilating system before being recirculated.

Full details of the present invention are set forth in the accompanying drawings and the following description.

BRIEF DESCRIPTION OF THE DRAWINGS IN THE DRAWINGS

DESCRIPTION OF THE INVENTION

Figure 1:
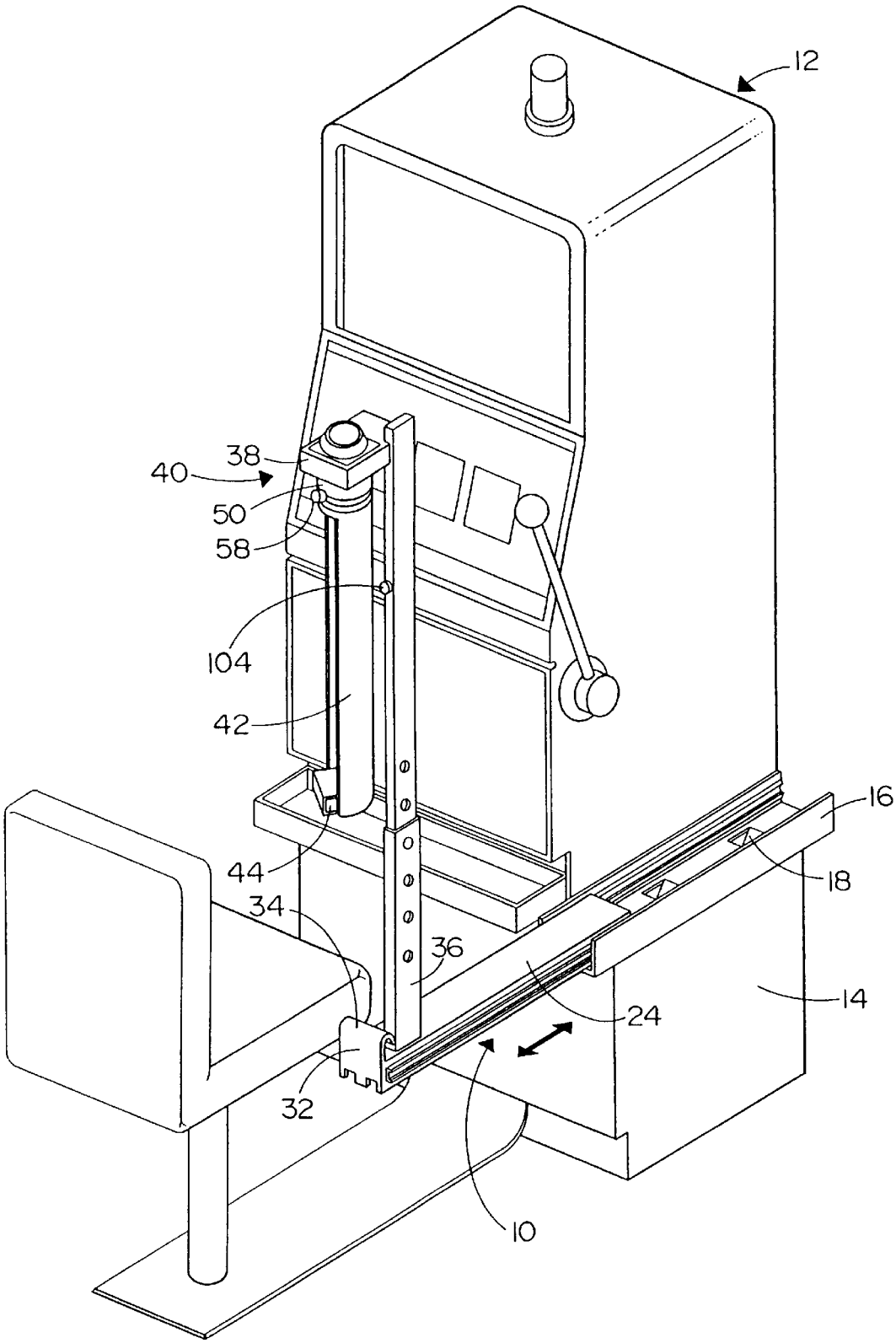
FIG. 1 is a perspective view of a slot machine installation showing the apparatus of the present invention applied thereto.

As seen in FIG. 1, the smoke removal apparatus, generally depicted by the numeral 10, is illustrated in use in association with a slot machine 12 of the type normally used in a gambling casino. The slot machine is mounted on a table or cabinet 14 at a level most convenient for a user seated at its front. The slot machine is conventional and because it has no function in the present invention, except to define the environment for he present invention, will not be further detailed. Reference, of course, can be made to various publications showing casinos and to the publications of the Bally Manufacturing Co., the leading maker of slot machines.

Figure 2:
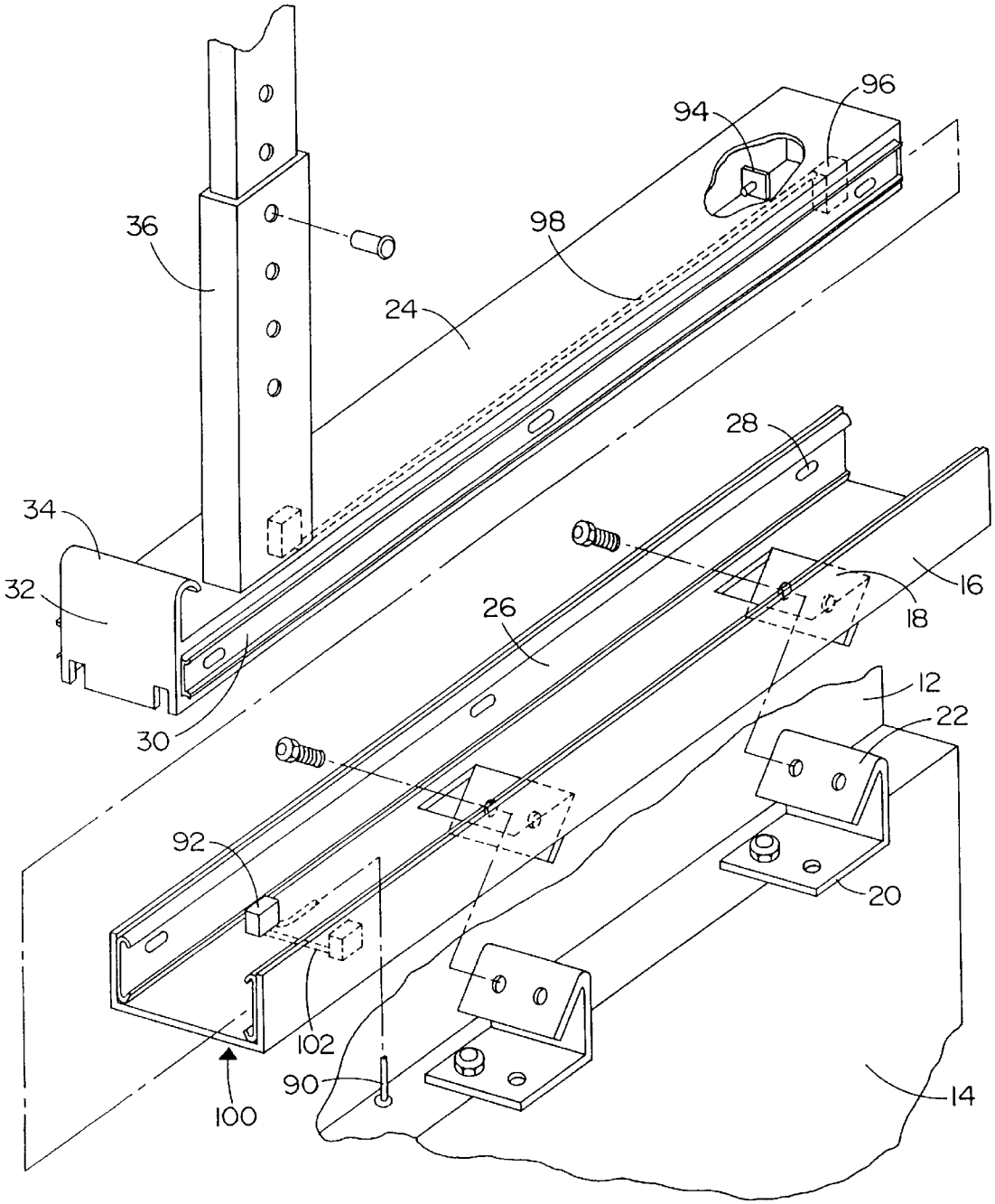
FIG. 2 is an exploded, enlarged view of the movable support employed in the present invention.

The apparatus of the present invention 10 is set on the narrow ledge between the slot machine 12 and the side edge of the cabinet 14 so as to be adjacent to the slot machine but not too close as to interfere with the operation of the slot machine, e.g., the operating handle. The apparatus 10 comprises a chimney assembly set upon a movable base assembly allowing the chimney assembly to be pulled forwardly adjacent the patron, when it is to be used and pushed backwardly out of the way when not in use. As seen in detail in FIG. 2, the base comprises an elongated U-shaped lower channel member 16, the bottom wall of which is provided with a pair of plates 18 cut there from and bent downwardly at an angle. Fixedly mounted to the top of the cabinet 14 are a pair of bent brackets 20, having an inclined leaf 22 conforming to the downward angle of plate 18. The brackets 20 are spaced conformingly to the distance between the plates 18 so that on installation, the lower channel 16 may be secured to the brackets 20 by passing suitable bolts or screws through the plates 18 and leafs 22. In this manner, the lower channel 16 may be removably attached to the cabinet 14 without having to move the slot machine or the cabinet.

Inserted from the front of the lower channel member 16 is a substantially conforming elongated inverted U-shaped upper channel member 24 having its bottom wall 26 exposed. The lower channel member 16 is provided along each of its side walls, below its top edge with an elongated two way travel slide mechanism 28, which the upper channel is suspended for conjoint reciprocal movement inwardly and outwardly of both, the front and rear end of the lower channel. The front and rear ends of the slide member 28 are provided with detentes preventing unwanted movement of the slide and upper channel member outwardly of the lower channel member. A two way travel slide mechanism, such as a conventional used for cabinet drawers, and the like may be used. The front end of the upper channel member 24 is provided with a wall 32 which extends upwardly to form a handle 34 by which movement of the channel member 24 is facilitated.

Mounted adjacent the front wall 32 of the upper channel member is a vertical post 36. The post 36 is securely fixed to the slide 24 as by welding, so as to have conjoint fixed movement with it. Extending laterally from the upper end of the post 36 is a horizontal bracket 38, from which hangs the smoke removal chimney assembly. The chimney 40 depends downwardly into a position to the side of the slot machine 12 at a level with the head of the user. The entire assembly of base, channel slide, vertical wall and bracket are dimensioned and positioned so that at no time during their movement and/or operating, do they interfere with the slot machine apparatus.

The chimney assembly comprises a cylinder 42, having a chordal opening of about one-half of its circumference (see FIG. 4). The bottom of the cylinder 46 is closed and provided with an ashtray 44 while the top of the cylinder is open and provided with a swivel joint assembly.

Figure 5:
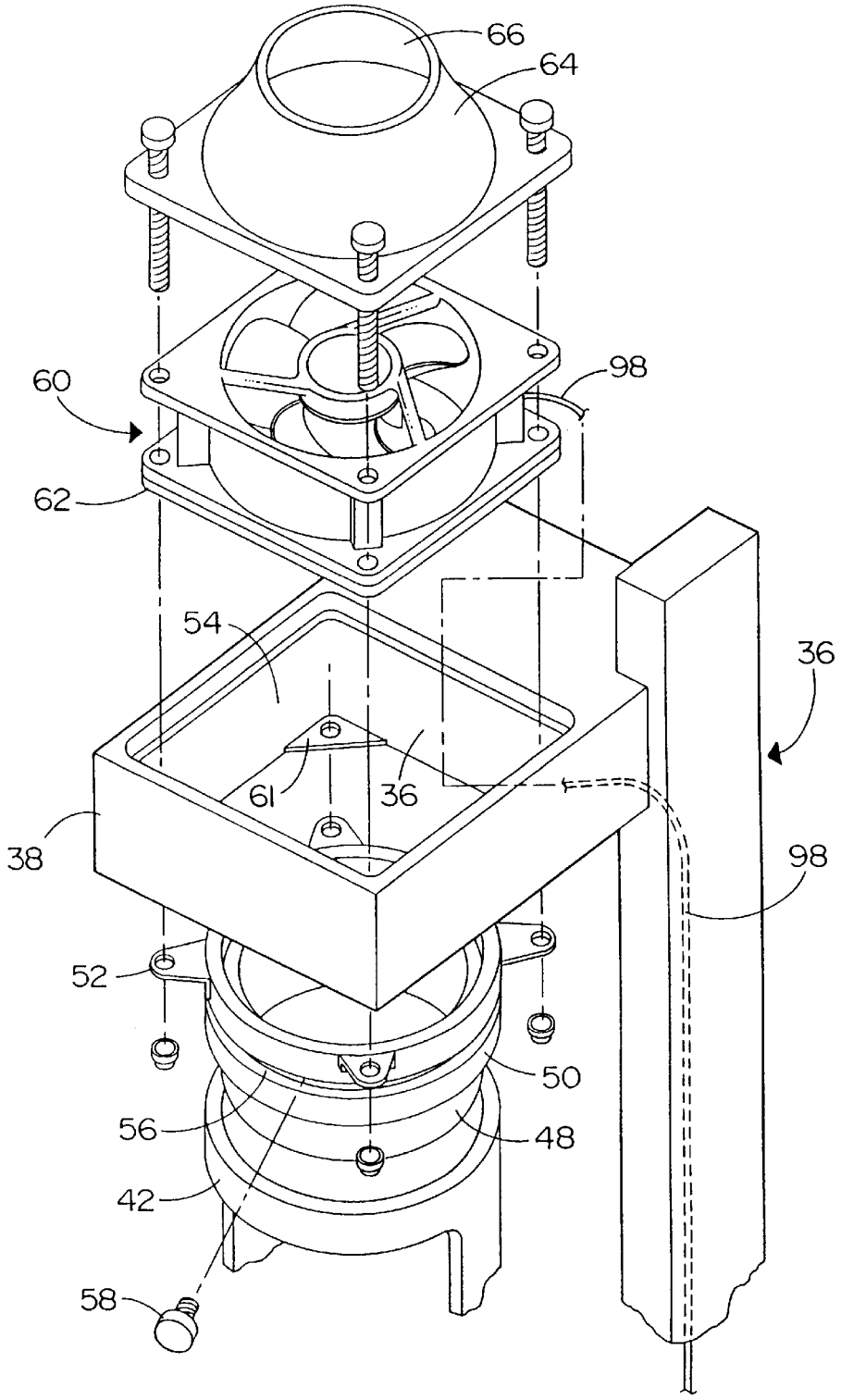
FIG. 5 is an exploded and enlarged view of the mechanism for hanging and rotating the chimney and the exhaust mechanism associated therewith.

In detail, as seen in FIG. 5, the swivel joint comprises a ring neck 48 fixedly secured to the open end of the cylinder 42 for conjoint rotation. Rotably fit over the neck 48 is a collar 50 which is itself fixedly and staticly attached to the lateral bracket 38 by bolts or screws passing through tabs 52. The lateral bracket 38 is provided with a cut out opening 54 aligned with the neck 48 and collar 50 to allow free flow of air from the cylinder. The collar 50 is provided with a slot 56 through which passes the shank of a thumb screw 58 which is removably secured in the neck 48. In this way, the neck and collar are relatively rotable within the range of the slot 56 and may be easily disconnected one from the other by removal of the set screw. The screw 58 also serves as a handle for manually turning the neck and entire chimney cylinder 42. It will, of course, be appreciated that other forms of swivel joints can be used.

Figure 3:
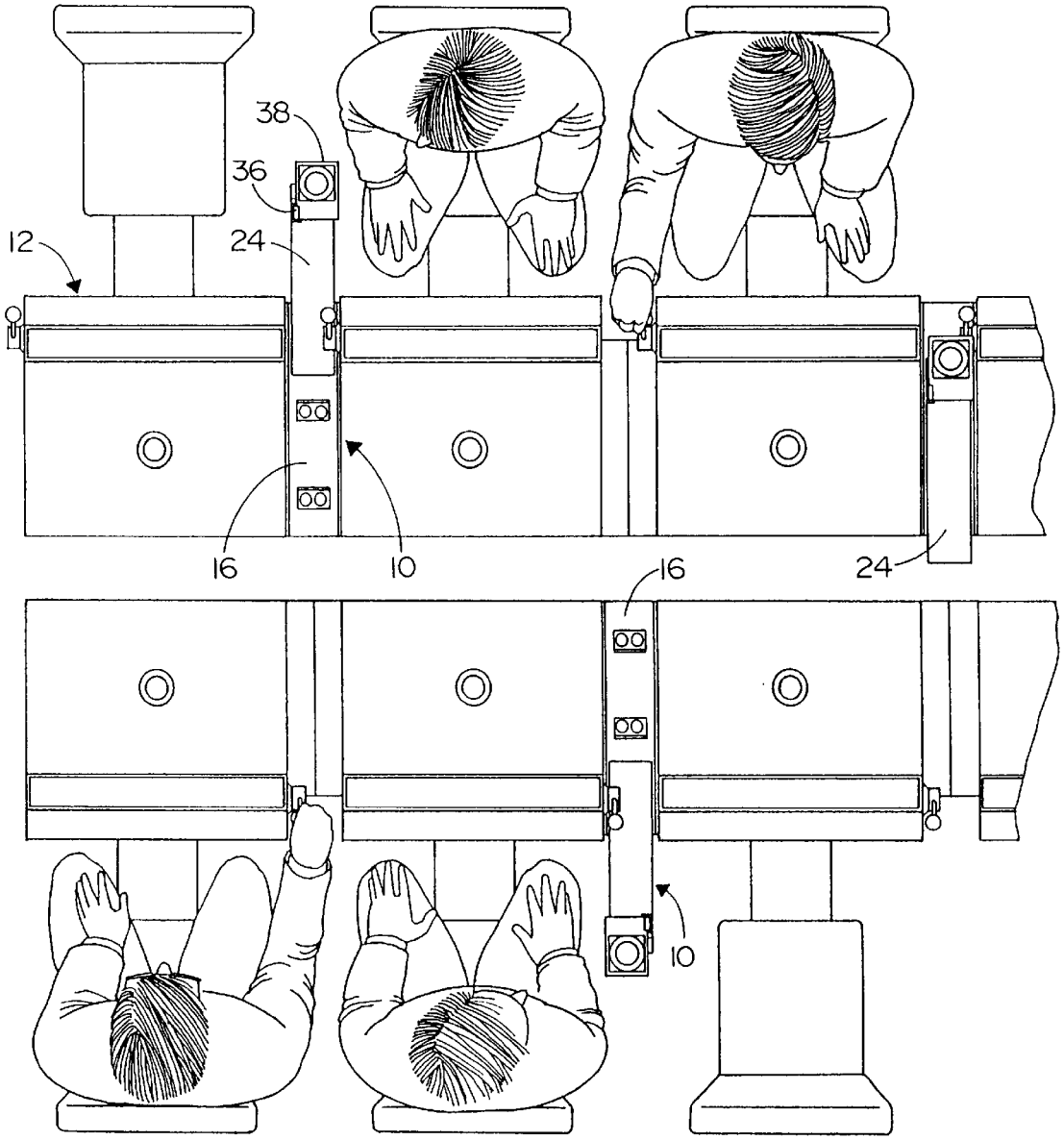
FIG. 3 is a plan view showing an array of players at adjacent slot machines sharing the apparatus of the present invention.

As seen in FIG. 3, by swiveling the chimney cylinder 42, the same apparatus may be employed alternatively or selectively by players facing the same way at adjacent slot machines. When slot machines are arrayed back to back, also as seen in FIG. 3, the smoke removal apparatuses are offset so that the movement of the base assembly of one, in the rearward direction is parallel to, but spaced from the other. In this way, back to back apparatuses will not interfere with each other.

Turning to FIG. 5, an exhaust fan 60 is located above the cut-out opening 54 formed in bracket 38. The fan 60, and if desired, a grid 62 is mounted on the bracket 38. The fan grid rests upon corner tabs 61 formed at the bottom of the opening 54 and suitable screws, bolts or other fasteners may be used to fix the fand and grid in place. The fan facilitates the movement of the air through the cylinder 42, producing a slight under pressure in the chimney cylinders, which acts to grasp the smoke more positively. It may be desirable to mount an extension or the like such as a tubular member 64 on top of the fan and to provide the extension with a curving reduced interior 66 forming a venturi like nozzle to propel the smoke to a height selected to be above the breathing level of most people.

Figure 4B:
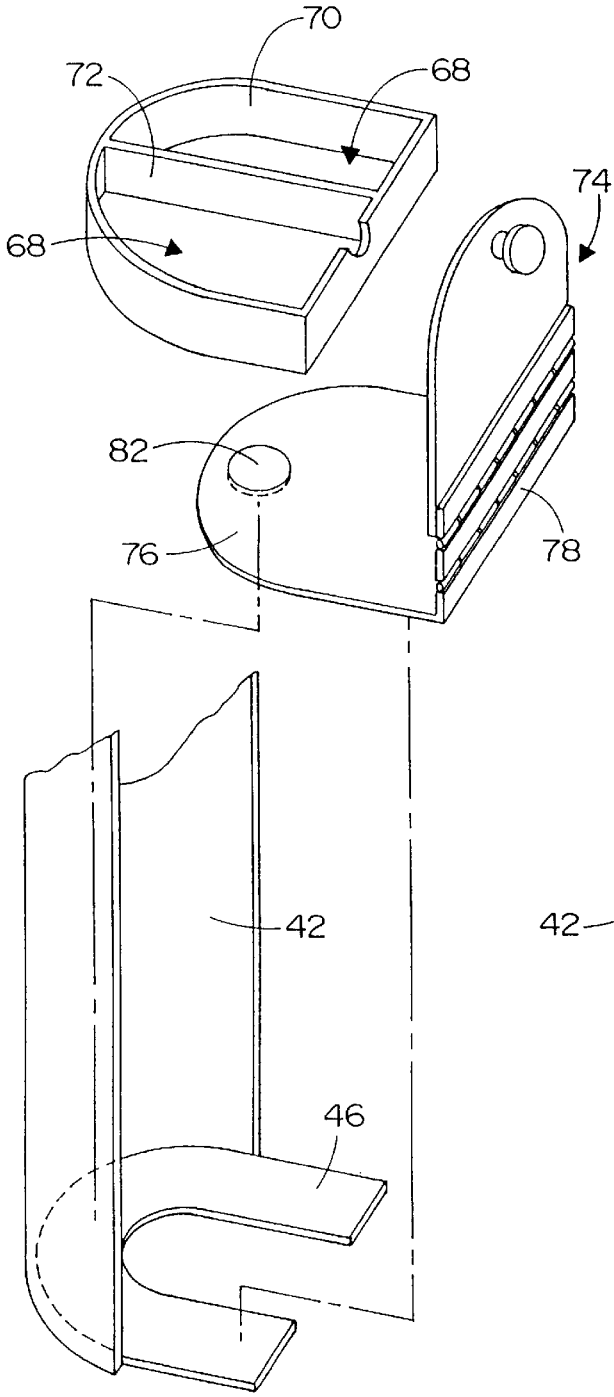
FIG. 4 is an exploded, enlarged view of the chimney and ashtray employed in the present invention.

In the enlarged, exploded view of FIG. 4, the details of the ashtray 44 is shown as well as is mounting on the cylinder 42. The bottom wall 46 of the cylinder 42 is in the shape of a horseshoe allowing space for the insertion of the users finger or fingers, while providing a stable shelf on which the ashtray 44 removably sits. The ashtray comprises a semi circular body 68, having a peripheral wall 70 for holding the ash and waste. The interior of the body 68 is provided with a separating wall 68 to define distinct areas, respectively, one for ash and one for stubbing out cigarettes, the latter being filled with sand or the like. The ashtray 44 is provided with a cover 74, having a flat rigid bottom 76 on the back 78 of which is hinged a cover flap 80. The back wall 78 is designed so that when the bottom 76 and cover 80 are placed parallel to each other, the ashtray body 68 fits snugly there between. In this manner, the ashtray can be inserted within the semi cylindrical hood seated properly and stably on the bottom wall, the cover flap 80 being then pivoted to expose the interior of the ashtray for use (FIG. 4B). When the ashtray is full and must be changed, the cover flap is replaced over the top of the body so that the ashtray can be manually removed and replaced with a clean assembly. Because the cover flap 80 closes the ashtray, the attendant is protected against burn, and the waste and ash is prevented from falling out. If desired, the bottom 76 of the ashtray may be provided with a magnet 82 on the bottom cooperating with a ferrous bottom wall for additional security in holding the ashtray.

The use of the present apparatus is seen from FIG. 1. The user, i.e., casino patron, after seating himself, pulls the apparatus forward by grasping the handle 32 so that the semi cylindrical chimney is located in line with his face, but off to one side so as not to interfere with the slot machine while the user is playing. The chimney is rotated by manipulation of the knurled screw 58 so that the chordal opening is available in a position where the user can easily exhale into the chimney.

With the operation of the fan, the smoke will rise rapidly (see arrow A) from the hood directly toward the ceiling of the room, thereby maintaining the lower level of the room free of smoke.

Figure 4A:
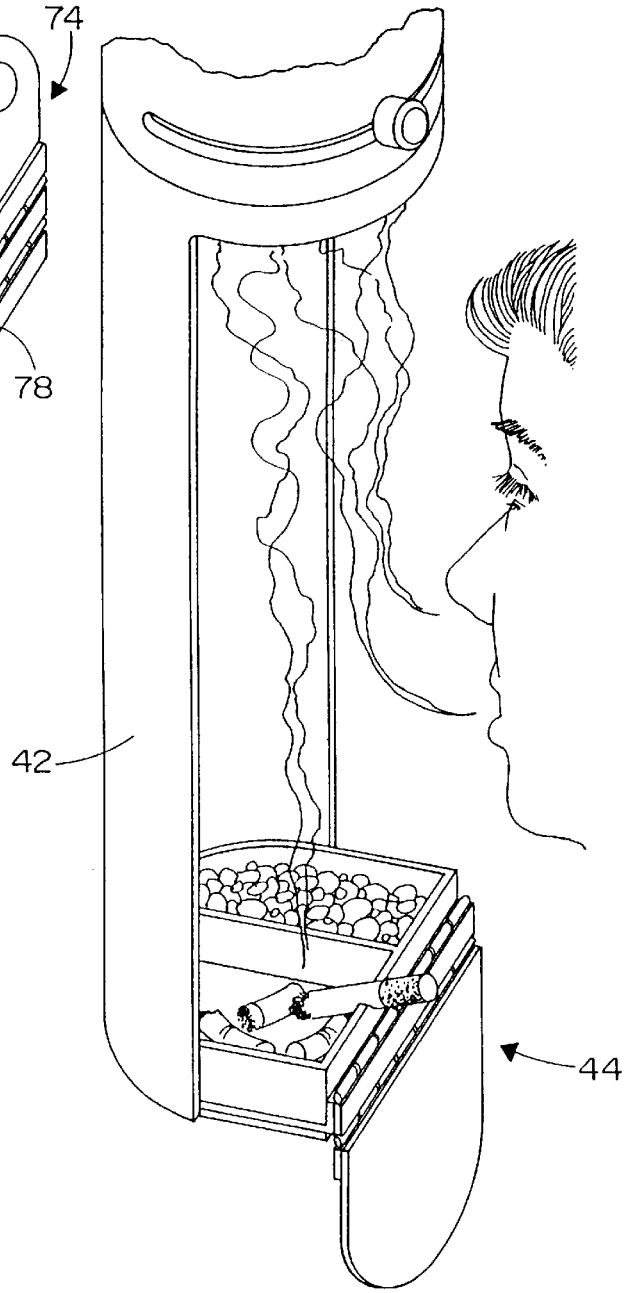

Random smoke from lit cigarettes etc. or ash in the ashtray will also rise as seen by the arrows in FIG. 4A.

The apparatus is provided with several control and safety features which are electrically operated. Returning to FIG. 2, electrical power is provided from a conventional line source (not shown) through a conduit 90. The conduit 90 is connected to a normally open (non-conductive) microswitch 92, fixedly located at the front of the base 16 along one side wall. The microswitch 92 defines a female socket member. Spaced rearwardly on the same side within the slide 24, in alignment with the microswitch 92, is a detent member 94. The detent is located at a distance equal to the distance the slide member 24 is to be extended forwardly, so that pulling the slide forward for use, the microswitch 92 is closed. Opposite to the detent member 94 along the other wall of the slide 24, is a male plug 96 from which a conduit 98 extends up the post 36 to the fan 60. At the front end of the base, opposite the microswitch 92, is a female socket 100 connected by conduit 102. Thus, as the slide 24 comes to its extreme extended position for use, the detent member 94 activates the microswitch 92 while the male plug 96 engages the female socket 100 causing power to flow through to the fan 60. As a safety measure, the fan should, itself, be provided with an on/off switch of conventional design. Further, if desired, a light or lamp 104 can be attached to the post 36 and connected to the conduit 98 so that the lamp 104 will illuminate when the fan 60 is working to indicate to the user that the device is in operation. The front wall 32 of the upper channel is provided with cut-outs, openings etc. to permit the slide to pass over the microswitch when the slide is moved rearwardly.

Various modifications and changes have been disclosed herein, and others will be apparent to those skilled in this art. Therefore, it is to be understood that the present disclosure is by way of illustration and not limiting of the present invention.

What is claimed is:

1. An apparatus for capturing and propelling tobacco smoke, the apparatus being attached to a supporting surface, the apparatus having a base for attaching to the surface, a chimney assembly defining an air column mounted on said base, and an exhaust fan disposed at the upper end of said chimney assembly:

said chimney assembly comprising a hollow duct having a bottom wall and being open along a vertical segment for the introduction of smoke and ash, the improvement comprising a removable ashtray having an interior and a peripheral wall, said interior having a separating wall to define a first area for receiving and permitting the extinguishment of a cigarette and a second area for ash, said ashtray conforming to the shape of the bottom wall of the duct for snug, stable seating within the chimney assembly, said smoke being sucked upwardly by the exhaust fan so that smoke emanating from said ashtray will be efficiently captured.

2. The apparatus according to claim 1, wherein said ashtray is provided with a removable cover having a flat bottom wall, a back wall and an openable cover flap hingedly mounted to said back wall, said ashtray being insertable and sealable within said cover when said cover flap is closed.

3. The apparatus according to claim 2, wherein said bottom surface of said cover has a magnet that cooperates with said chimney assembly so as to hold the ashtray in place.

4. The apparatus according to claim 1, wherein said bottom wall of said cylindrical duct is horseshoe-shaped providing access to the ashtray from above and below, while providing a stable shelf on which to seat said ashtray.

* * * * *